US006182713B1

(12) United States Patent
Deck et al.

(10) Patent No.: US 6,182,713 B1
(45) Date of Patent: Feb. 6, 2001

(54) INSTALLATION FOR FILLING A CONTAINER WITH GAS

(75) Inventors: Philippe Deck, Montreuil; Jean-Philippe Dhalluin, Paris Cedex; Christophe Knapik, Antony, all of (FR)

(73) Assignee: L'Air Liquide, Societe Anonyme pour l'Etude et l'Exploitation des Procedes Georges Claude, Paris Cedex (FR)

( * ) Notice: Under 35 U.S.C. 154(b), the term of this patent shall be extended for 0 days.

(21) Appl. No.: 09/373,631

(22) Filed: Aug. 13, 1999

(30) Foreign Application Priority Data

May 26, 1999 (FR) ..... 99 06651

(51) Int. Cl.[7] ..... B65B 1/04

(52) U.S. Cl. ..... 141/18; 141/2; 141/104; 141/197

(58) Field of Search ..... 141/2, 9, 18, 20, 141/100, 104, 197, 83, 192

(56) References Cited

U.S. PATENT DOCUMENTS 4,582,100 4/1986 Poulsen .
5,409,046 * 4/1995 Swenson et al. ..... 141/11
5,551,490 * 9/1996 Kountz et al. ..... 141/21
5,673,735 * 10/1997 Crvelin et al. ..... 141/197
5,901,758 * 5/1999 Hwang et al. ..... 141/2

FOREIGN PATENT DOCUMENTS 26 40 842 3/1978 (DE) .
36 37 925 7/1987 (DE) .
0 660 027 6/1995 (EP) .

* cited by examiner

*Primary Examiner*—Steven O. Douglas
(74) *Attorney, Agent, or Firm*—Young & Thompson

(57) ABSTRACT

An installation for filling cylinders with gas whose nature is in accordance with a predetermined specification, it comprises a plurality of sources of supply (18, 20), a network of control valves (12), selectively connecting the outlet of each supply gas source to the cylinders, and a unit (16) for controlling the network of valves adapted to control the condition of the valves. The control unit (16) comprises a unit (60) for inputting into a program constituted by a sequence of procedures, each procedure being an elemental task that can be performed by the valves under the control of the control unit (16). It moreover comprises a unit (62) for processing the successive procedures constituting the program. They are adapted to control the network of valves (12) by the sequential performance of the elemental tasks described successively in the sequence of operations.

14 Claims, 4 Drawing Sheets

INSTALLATION FOR FILLING A CONTAINER WITH GAS

FIELD OF THE INVENTION

The present invention relates to an installation for filling a container with gas whose nature is according to a predetermined specification, comprising:

an assembly or plurality of sources of supply gas;

at least one connector for connecting the or each container;

a network of control valves, selectively connecting the output of each supply gas source to the or each connector; and a drive or control unit for the network of valves adapted to control the condition of the valves for filling the or each container with a gas according to the predetermined specification.

BACKGROUND OF THE INVENTION

Pure gases or gaseous mixtures are now filled into cylinders or frames carrying a group of cylinders. They are filled in a filling installation and then brought to the site of utilization of the gas.

So as to permit the filling of containers with gases of different compositions and under different pressures, the filling installations conventionally comprise a network of valves permitting selectively connecting to the container to be filled an assembly of sources of supply gas.

To ensure filling of the container with a gas satisfying a predetermined specification, the opening and closing of the valves is at present entrusted to an operator. The latter opens and closes the different valves, at predetermined moments, and according to a predetermined sequence. The operation of such an installation therefore requires the continuous presence of an experienced operator who determines the sequence of operations.

It has been proposed to replace manual valves by control valves connected to a drive unit adapted to control the condition of the valves for filling a receptacle with a gas according to the predetermined specification.

In such an installation, the drive unit is adapted to receive at its input the specifications of the gas to be introduced into the container. The input data consist particularly in the mass composition, or in the pressure of the different components constituting the gas. Thus, the information input into the drive unit is the result relied on for the filling operation.

Such a filling installation requires an extremely complex drive unit whose program that is utilized depends both on the physical structure of the network of valves used and on the nature of the gases to be introduced.

By way of example, FR-A-2.713.105 describes an installation for filling a reservoir with a gaseous mixture. This installation comprises a computer driving the cyclic opening and closing of valves arranged between the reservoir and sources of gas under pressure. The computer receives as its controls the composition relied on to effect the mixture. It is adapted to predetermine and carry out a cycle for driving the various valves so as to obtain the desired mixture.

Moreover, JP-2675633 describes an installation for filling cylinders comprising several sources of gas that can supply selectively the cylinders under the control of a control unit. The operational steps of the control unit and the input variables are not disclosed.

OBJECT OF THE INVENTION

The invention has for its object to provide a simple installation for filling, permitting making uniform and standard the installations used for filling at various sites, thereby facilitating the filling of containers whilst improving the reproducability and reliability of the operations of filling with gas.

SUMMARY OF THE INVENTION

To this end, the invention has for its object an installation for filling at least one container with gas whose nature is according to a predetermined specification, comprising:

an assembly of sources of supply gas;

at least one connector for connecting the or each container;

a network of control valves, selectively connecting the output of each source of supply gas to the or each connector; and a drive unit for the network of valves adapted to control the condition of the valves for filling the or each container with a gas according to the predetermined specification;

characterized in that:

said driving unit comprises means for inputting a program constituted by a sequence of procedures, each procedure comprising an elemental task to be performed by the network of valves under the control of the drive unit, and in that said driving unit comprises means for processing successive procedures constituting the program, said means being adapted to control the network of valves to perform sequentially the elemental tasks described successively in the sequence of procedures constituting the program.

According to particular embodiments of the invention, the installation comprises one or several of the following characteristics:

each procedure comprises the identification of a single valve to be controlled in the network of valves, upon performing the corresponding elemental task, and the data relative to the manner of actuating the valve;

the data relative to the manner of actuating each valve comprises a reference value, the installation comprises an assembly of detectors adapted to carry out operations on the condition of filling the or each container, and the processing means are adapted to end the actuation of the valve when the step carried out reaches the corresponding reference value;

the assembly of detectors comprises at least one selected from a detector for measuring temperature of the gas and at least one container, a balance for weighing at least one container, a pressure detector disposed upstream of at least one container, and a humidity detector disposed down-stream of at least one container;

the data relating to the manner of actuating the valve comprises a time delay, and in that the processing means comprise a timing adapted to differentiate, from said time delay, the performance of the following elemental task after the end of actuation of the valve concerned with the procedure being performed;

it comprises a vacuum pump and the valve network comprises means selectively to connect the vacuum pump to the or each connector under control of said drive unit performing an elemental task of placing under vacuum, involved in the procedural sequence constituting the program;

it comprises an outlet to the atmosphere and the valve network comprises means selectively to connect the outlet to the atmosphere to the or each connector under control of said drive unit performing an elemental task of connecting to the atmosphere involved in the procedural sequence constituting the program; and it comprises at least two assemblies of connectors for connecting the containers, said assemblies of connectors are connected in parallel to the outlet of the network of valves by means of a selection valve individual to each assembly of connectors.

BRIEF DESCRIPTION OF THE DRAWINGS

The invention will be better understood from a reading of the description which follows, given solely by way of example and having reference to the drawings, in which.

DETAILED DESCRIPTION OF THE INVENTION

Figure 1:
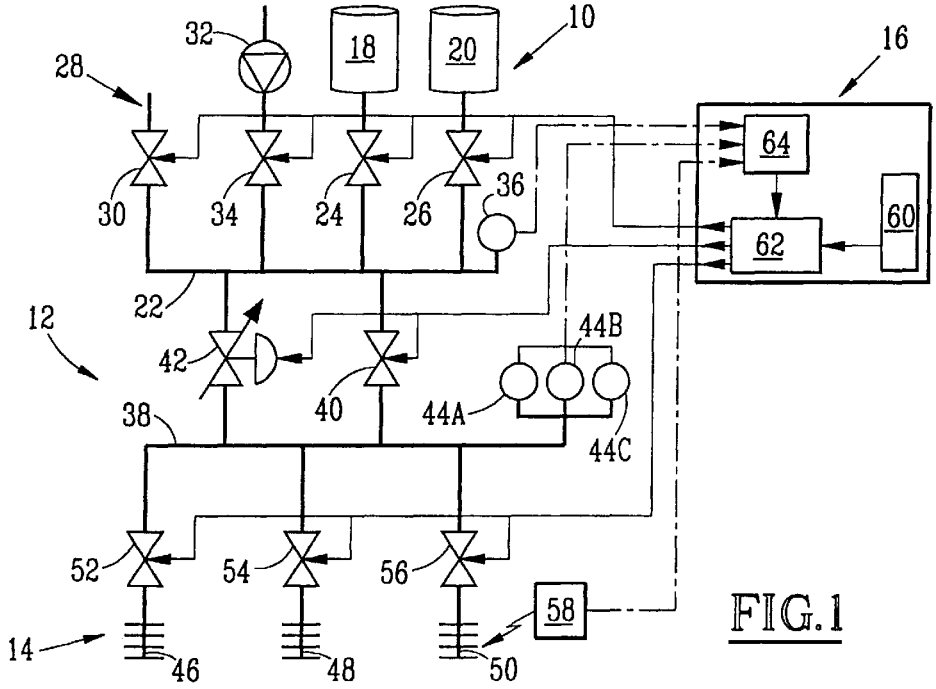
FIG. 1 is a schematic view of an installation for filling cylinders with a mixture of compressed gas, with control by pressure corrected for temperature.

The installation shown in FIG. 1 comprises, as any filling installation according to the invention, an assembly 10 of sources of supply gas and a network 12 of control valves, selectively controlling the outlet of each source of supply gas, to an assembly 14 of connectors constituting points of connection for the cylinders to be filled. It comprises moreover a unit 16 for driving the network of valves 12.

In the illustrated example, an oxygen supply 18 and a nitrogen supply 20 are provided at the inlet of the network of valves 12. These sources of gas are connected to a principal supply conduit 22 through control valves 24 and 26.

The principal supply conduit 22 is connected to an outlet 28 for connecting to the atmosphere by means of a control valve 30.

Finally, a vacuum pump 32 is connected to the principal supply conduit 22 by means of a control valve 34.

The valves 24, 26, 30, 34 permitting the selective connection of the principal supply conduit 22 to a source of gas, to the outlet connection to the atmosphere 28 or to the vacuum pump 32, are controlled from the drive unit 16.

A supply pressure detector 36 is mounted on the principal supply conduit 22. This pressure detector is connected to the drive unit 16.

The principal supply conduit 22 is connected to a principal distribution conduit 28 by means of a selecting valve 40 and a regulating valve 42. These two valves 40, 42 are mounted in parallel and are controlled from the drive unit 16. They ensure the adjustment of the flow rate of filling the cylinders.

In the distribution conduit 38 are provided three pressure detectors 44A, 44B, 44C having respectively ranges of measurement of 300 bars, 40 bars and 5 bars. These pressure detectors are connected to the drive unit 16 so as to communicate to the latter the pressure in the distribution conduit 38.

The assembly of points 14 for connecting the cylinders are distributed in three rows 46, 48, 50. Each row comprises in general 16 connection points, each suitable for the connection of a 50-liter cylinder.

The rows 46, 48, 50 are connected in parallel to the distribution conduit 38 by means of a control selecting valve 52, 54, 56 individual to each row. These valves are connected to be controlled by the drive unit 16.

Finally, an infrared probe 58, for measuring the temperature, is provided adjacent the row 50. The probe 58 is connected to the drive unit 16. It is adapted to be applied to a cylinder and to measure the filling temperature of this cylinder.

The temperature measured by the probe 58 permits the drive unit 16 to correct the target pressures as a function of the temperature, so as to ensure filling of the cylinders at a desired pressure under normal temperature conditions.

According to the invention, the drive unit 16 comprises means 60 for inputting a program for filling a group of 16 cylinders with a gaseous mixture whose nature is according to a predetermined specification.

Each program is constituted by a sequence of successive procedures. Each procedure comprises an elemental step that can be carried out by the assembly of valves under the control of the drive unit 16.

Each procedure is characterized by the designation of one valve, and data relative to the control of the operation. In particular, these data comprise first of all the actuating mode of the valve, the standard which is to be achieved which stops the actuation of the valve, the tolerance applicable to the standard in percentage, and the time delay in seconds between the actuation of a valve and the onset of actuation of the following valve.

According to a first embodiment of the invention, the programs are established manually by transcribing with the procedure defined above, the successive elemental steps practiced by an operator.

As a modification, the programs are established by data processing means receiving at their input the desired characteristics for the gas filling the cylinders.

From a suitable algorithm, taking account of the thermodynamic laws of the gases in question, the data processing means determine the sequence of procedures constituting the program.

This program is stored on a support permitting its ultimate use by the installation according to the invention.

The drive unit 16 is for example constituted by an industrial computer or a programmable robot using a suitable program.

The input means 60 for the program comprise for example a bar code reader. In this case, the programs are presented on a support material, such as a sheet of paper in the form of a succession of bar codes. Each bar code preferably corresponds to a procedure of the program.

As a modification, the programs are stored on magnetic supports, such as diskettes. The input means 60 then comprise a reader suitable for the magnetic support.

According to still another modification, the input means 60 comprise a connection to a local network for data transfer, permitting sending programs from a remote station toward the drive unit 16.

So as to ensure the driving of the network of valves 12, the drive unit 16 comprises means 62 for processing successive procedures constituting the input program. These latter are adapted to control the network of valves 12 for sequentially practicing the elemental tasks embodied in the sequence of procedures constituting the program. Each of the control valves is connected to the processing means 62.

The means 62 for processing the procedures comprise a timer adapted to differentiate, from a predetermined time delay, the performance of the following elemental task, after the conclusion of actuation of the valve corresponding to the procedure then in progress.

The drive unit 16 moreover comprises means 64 for the collection of measurements carried out by the various detectors of the installation. These collecting means are connected to the means 62 for processing successive procedures such that the latter stop the actuation of a selected valve when the measurement carried out by a detector reaches a reference value.

Table 1 describes by way of example a program for filling 16 cylinders of a volume of 50 liters with medical oxygen under a pressure of 201 bars absolute at 15° C., ±15%.

TABLE 1

| Valve | Mode | Standard | Class | Delay |
|---|---|---|---|---|
| To the atmosphere | Dropping to (bars) | 1.50 | 20.00 | 1 |
| Under vacuum | Dropping to (bars) | 0.20 | 20.00 | 1 |
| Oxygen | Increasing to (bars) | 5.00 | 20.00 | 4 |
| To the atmosphere | Dropping to (bars) | 1.50 | 20.00 | 1 |
| Under vacuum | Dropping to (bars) | 0.20 | 20.00 | 1 |
| Oxygen | Increasing to (bars) | 201.00 | 5.00 | End |

The program given here comprises six procedures each corresponding to a line on the table.

Considering the program in the table of FIG. 1, so as to obtain filling of the bottles, the first procedure used consists in carrying out opening the cylinders to the atmosphere by opening the atmospheric valve 30, so as to ensure a pressure drop to a pressure of 1.5 bar absolute ±20%. Once this pressure is reached, the atmospheric valve 30 is closed. After a time delay of a second, the vacuum valve 34 is opened to effect a pressure drop to a value of 0.20 bar absolute ±20%. After this pressure has been reached and after expiration of a time delay of one second, the oxygen inlet valve 24 is opened to ensure pressure increase in the cylinders to a pressure of 5 bars absolute ±20%.

Four seconds after this pressure has been reached, the atmosphere valve 30 is opened until the pressure in the distribution conduit 38 reaches a reference pressure value equal to 1.5 bar absolute ±20%.

After one second, the distribution conduit 38 is placed under vacuum by opening the vacuum valve 34 until the pressure falls to a reference pressure of 0.2 bar absolute ±20%.

The oxygen inlet valve 24 is then again opened until the pressure in the distribution conduit 38 and hence in the cylinders, reaches 201 bars absolute ±5%.

The cylinders thus filled are then closed and the installation is purged.

The presence of three filling rows 46, 48, 50 permits overlapping operations. Thus, each row is connected in parallel to the output of the valve network 12 through its own valve 52, 54, 56. Thus, while a group of 16 cylinders is filled on one of the rows, another group to be filled is installed on a second row, whilst a third group of cylinders, previously filled, is detached from the third row. During filling on a given row, the selecting valve associated with this row is open, whilst the valves of the other rows are kept closed, which permits operating on the cylinders.

Thus, the installation can ensure the filling of cylinders substantially continuously.

The selecting valve 40 mounted in parallel with the regulating valve 42 permits ensuring a diversion of the gas flow when the gas flow is maximum, the regulating valve being then inoperative. On the contrary, for low flows, which must be regulated with precision, the diversion valve 40 is closed and the flow substantially passes through the regulating valve 42.

In other filling installations shown in the subsequent figures, similar or identical elements to those in FIG. 1 are designated by the same reference numerals. Only the elements distinguishing the installations from that of FIG. 1 are described in detail.

Figure 2:
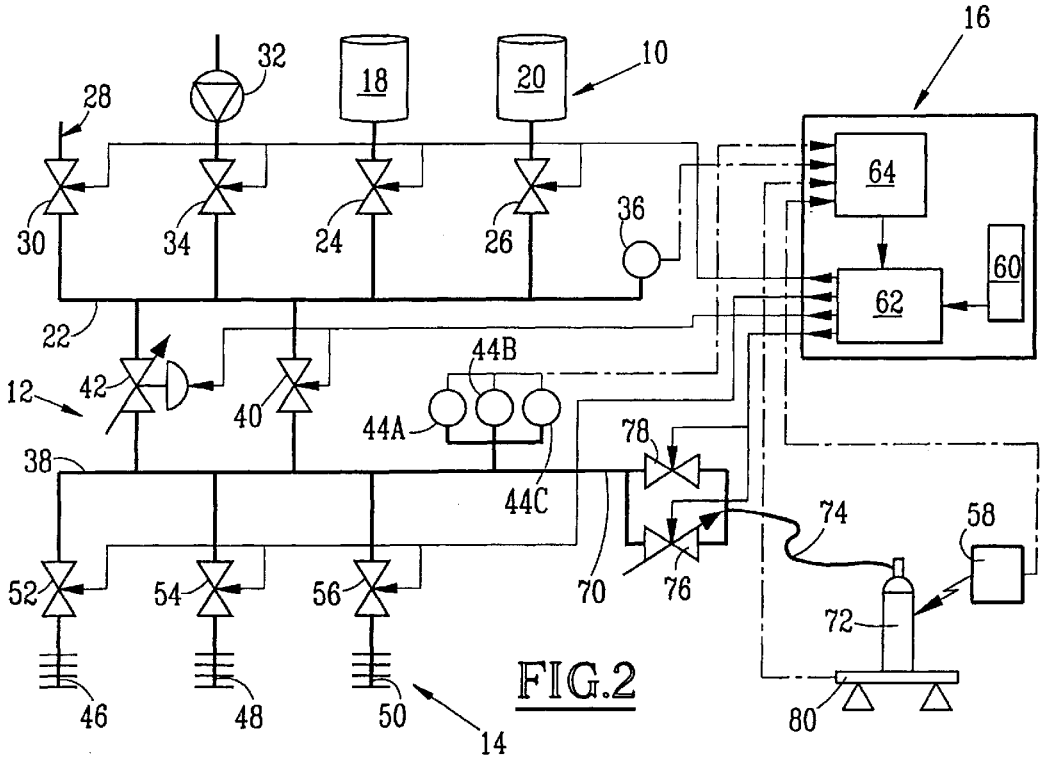
FIG. 2 is a schematic view of an installation for filling cylinders with a mixture of compressed gas, with control by pressure corrected for temperature and by the weight of a pilot cylinder.

The filling installation of FIG. 2 is adapted to fill with compressed gaseous mixtures as a function of the pressure corrected for temperature and weight of a pilot cylinder.

To this end, there is provided, on the distribution conduit 38, a diversion 70 to which is connected a pilot cylinder 72. This cylinder is connected to the end of a flexible line 74. The deflection 70 comprises a regulation valve 76 and a sectioning valve 78 in parallel. These valves 76 and 78 are controlled by the drive unit 16.

Moreover, a scales 80 is provided to carrying out continuously the weighing of the pilot cylinder 72. The scales 80 is connected to the drive unit 16.

The temperature probe 58 is disposed in the immedi- ate vicinity of the pilot cylinder 72, so as to determine the temperature of the gas contained in this latter.

Table 2 gives, by way of example, the program for filling 16 cylinders of a volume of 50 liters with a mixture of medical air constituted by 20% oxygen and 80% nitrogen with variation of 5%, under a pressure of 201 bars absolute.

TABLE 2

| Valve | Mode | Standard | Class | Delay |
|---|---|---|---|---|
| To the atmosphere | Dropping to (bars) | 1.50 | 20.00 | 1 |
| Under vacuum | Dropping to (bars) | 0.20 | 20.00 | 1 |
| Nitrogen | Increasing to (bars) | 5.00 | 20.00 | 9 |
| To the atmosphere | Dropping to (bars) | 1.50 | 20.00 | 1 |
| Under vacuum | Dropping | 0.20 | 20.00 | 1 |

TABLE 2-continued

| Valve | Mode | Standard | Class | Delay |
|---|---|---|---|---|
| | to (bars) | | | |
| Oxygen | Added weight (kg) | 2.633 | 5.00 | 4 |
| Nitrogen | Added weight (kg) | 9.294 | 5.00 | End |

The program shown here comprises seven procedures each corresponding to a line on the table.

Considering the program shown in Table 2, so as to obtain filling of the cylinders with a proportion of 20% oxygen and 80% nitrogen, the first procedure used consists in opening the cylinders to the atmosphere by opening the atmosphere valve 30 so as to ensure a pressure drop to a pressure of 1.5 bar absolute ±20%. Once this pressure has been reached, the atmosphere valve 30 is closed. After a time delay of one second, the vacuum valve 34 is opened to effect a pressure drop to a value of 0.20 bar absolute ±20%. After this pressure has been reached and after the expiration of a time delay of one second, the nitrogen inlet valve 26 is opened to cause a pressure increase in the cylinders to a pressure of 5 bars absolute ±20%.

Nine seconds after this pressure has been reached, the atmosphere valve 30 is opened until the pressure in the distribution conduit 38 reaches a reference pressure value of 1.5 bar absolute ±20%.

After one second, the distribution conduit 38 is placed under vacuum by opening the vacuum valve 34 until the pressure falls to a reference pressure of 0.2 bar absolute ±20%.

The oxygen inlet valve 24 is then opened until the weight of the pilot cylinder 72, determined by the scales 80, reaches 2.633 kg ±5%. Four seconds after the closure of the valve 24, the nitrogen inlet valve 26 is opened until the mass of one of the cylinders reaches 9.294 kg ±5%.

The cylinders thus filled are then closed and the installation is purged.

Figure 3:
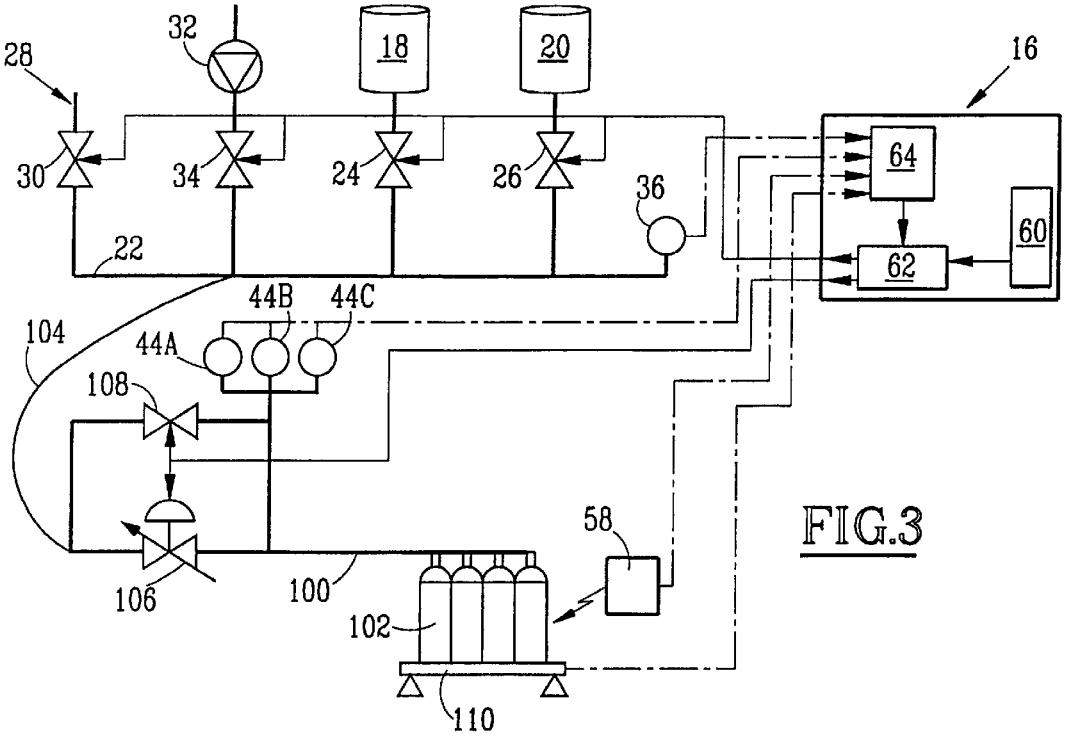
FIG. 3 is a schematic view of an installation for filling a group of cylinders with a mixture of compressed gas, with control by pressure corrected for temperature and by the weight of all of the group of cylinders to be filled.

The filling installation of FIG. 3 is adapted to fill mixtures of compressed gas as a function of the pressure corrected for temperature and the weight of the entire group of cylinders to be filled.

To this end, the installation comprises a single filling row 100 to which is connected all of the 16 cylinders 102 of a group to be filled. The filling row 100 is connected by a flexible line 104 to the principal supply conduit 22. In the flexible line 104 are provided a regulating valve 106 mounted in parallel with a cutoff valve 108. The valves 106 and 108 are connected to be controlled by the drive unit 16.

The pressure detectors 44A, 44B, 44C are mounted directly on the filling row 100.

A scales 110, to measure continuously the weight of the assembly of cylinders 102 of the group to be filled, is connected to the drive unit 16. The temperature probe 58 is disposed immediately adjacent the group of cylinders 102.

The presence of the flexible line 104 ensures that the weight measurement carried out by the scales 110 will not be influenced by the rigidity of the filling row 100, because this latter floats and is supported only by the cylinders 102.

It will be seen that such an installation permits filling the group of cylinders 102 according to a predetermined program. The latter comprises particularly procedures involving opening of the valves 26 to 30 until the standard pressures or weights for the assembly of cylinders is reached.

Figure 4:
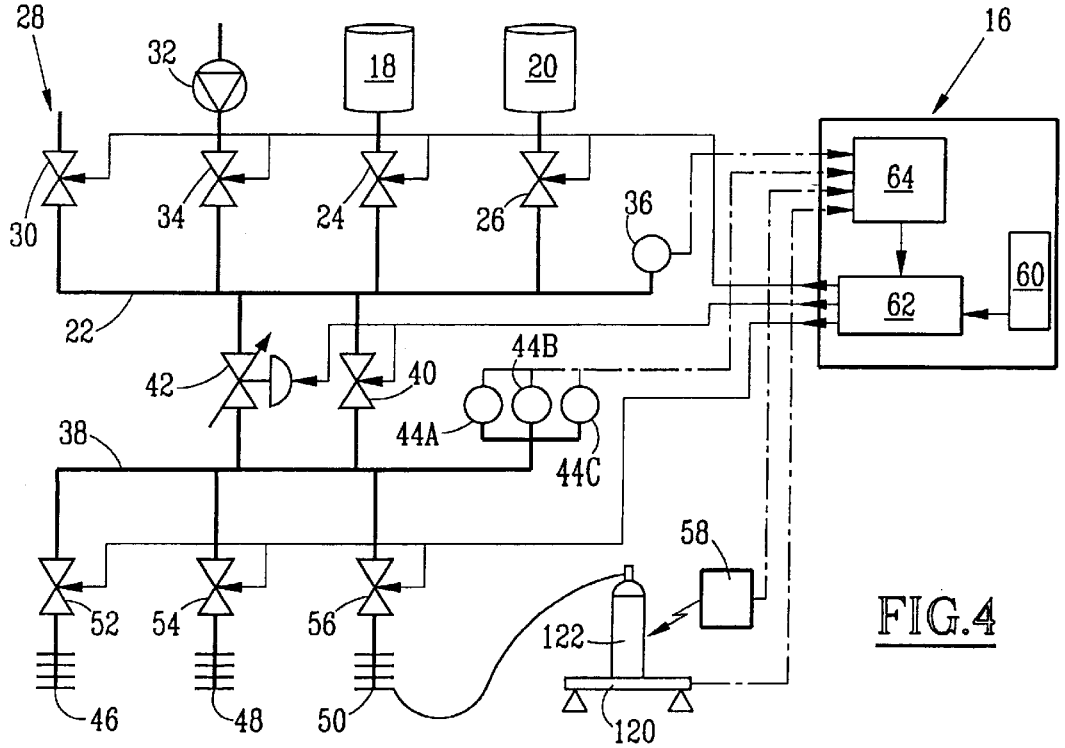
FIG. 4 is a schematic view of an installation for filling a group of cylinders with a mixture of compressed gas, with control by the pressure corrected for temperature and by the weight of one of the cylinders of the group of cylinders to be filled.

In FIG. 4 is shown a filling installation for a mixture of compressed gases regulated as a function of the pressure corrected for temperature and by the weight of one of the cylinders of the group to be filled.

To this end, the installation of FIG. 4 is substantially analogous to that of FIG. 1. It also comprises a scales 120 adapted to weigh one, namely 122, of the cylinders connected to the filling row 50. The scales 120 is connected to the drive unit 16. The temperature probe 58 is applied to the cylinder 122.

Figure 5:
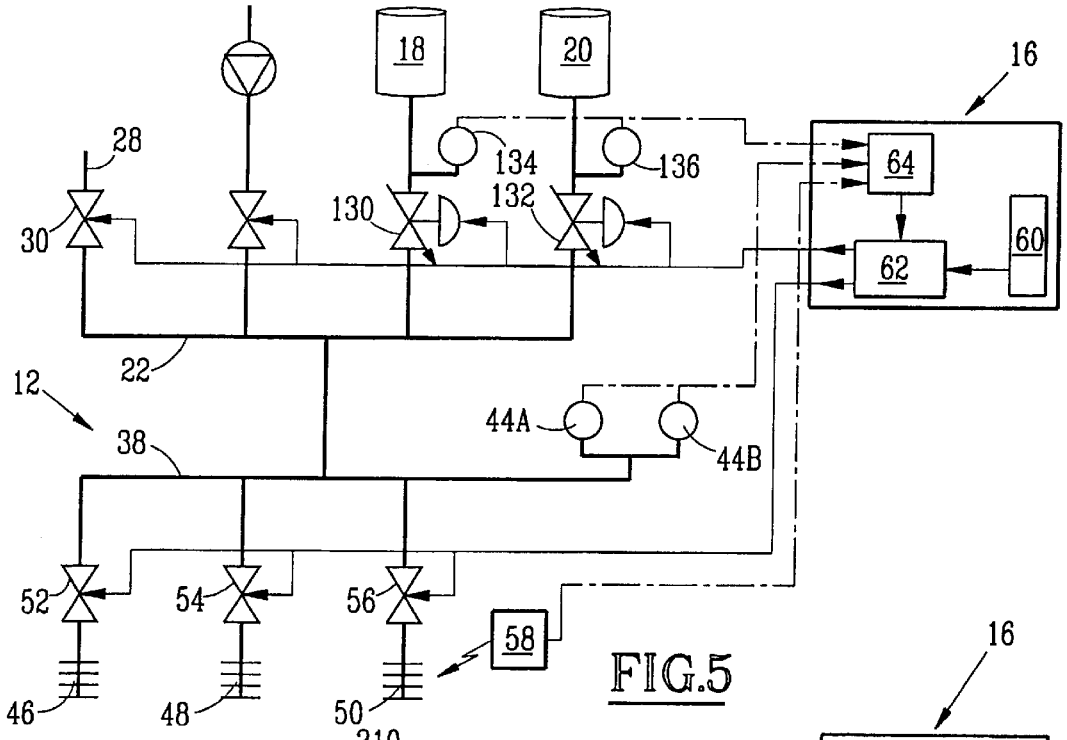
FIG. 5 is a schematic view of an installation for filling cylinders with a pure gas, with control by the pressure corrected for temperature of the pure gas.

The installation of FIG. 5 is adapted to handle a single gas with pressure regulation corrected for the temperature of the gas.

To this end, the installation is substantially analogous to that of FIG. 1. However, the diversion valve 40 and the regulating valve 42 are omitted. On the other hand, the valves 24 and 26, provided at the outlet of the gas sources 18 and 20, are replaced by proportioning valves 130, 132, controlled by the drive unit 16. Moreover, upstream of the proportioning valves 130, 132 are provided pressure detectors 134, 136 connected to the drive unit 16 so as to communicate the pressures of the supply gases.

In this embodiment, the flow rate of supply gases is adjusted not between the principal supply conduit 22 and the distribution conduit 38, but directly at the output of the gas sources 18 and 20 by means of the proportioning valves 130, 132.

The installations of FIGS. 4 and 5 operated by carrying out a program constituted of procedures defining the sequence of opening and closing of the valves is a function of the comparison of the measurements collected by the detectors with the standards defined in the procedures.

Figure 6:
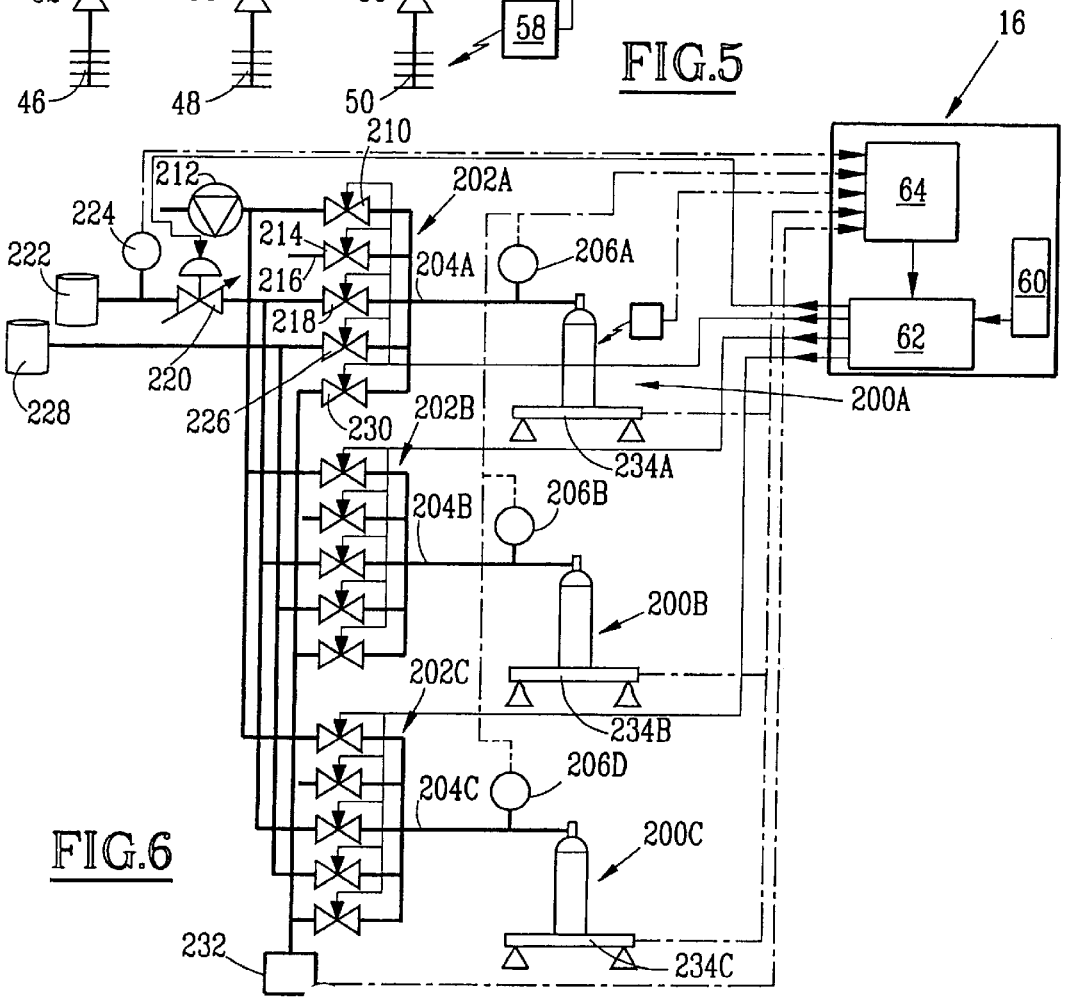
FIG. 6 is a schematic view of an installation for filling cylinders with a liquified pure gas, with control by the weight of the liquified gas and by the pressure corrected for temperature with initial flushing of the containers.

The installation of FIG. 6 is adapted to fill liquid gas regulated by the weight of the liquified gas, with rinsing of the cylinders. The rinsing operations are conducted according to pressure corrected for temperature.

Thus, a phase of handling a gas comprises an initial rinsing step of the cylinder followed by a step of filling properly so-called.

Under these conditions, the program includes a first rinsing step and then a second filling step, the steps of rinsing and filling being each constituted by a sequence of procedures.

The installation of FIG. 6 comprises three filling stations 200A, 200B, 200C that are identical and mounted in parallel.

Each filling station comprises its own network of valves designated 202A, 202B, 202C. The valves of each network have their outlet connected to a conduit 204A, 204B, 204C adapted for the connection of a cylinder to be filled. The conduits are each provided with a pressure detector 206A, 206B, 206C connected to the drive unit 16.

Each valve network 202A, 202B, 202C comprises a vacuum valve 210 assuring the selective connection of the cylinders with a common vacuum pump 212. Similarly, each valve network comprises a valve 214 controlling an outlet to the atmosphere 216.

A valve 218 for controlling the supply gas is provided in each valve network. Upstream of the gas supply valves 218 is mounted a common regulation valve 220 disposed at the outlet of a source 222 of gas to be filled, such as liquid $CO_2$. A pressure detector 224, connected to the drive unit 16, is provided at the outlet of the source of filling gas 222.

Similarly, each network of valves comprises a rinsing valve 226 controlling the connection of each cylinder with a common rinsing gas source 228.

Finally, each valve network comprises an analysis valve 230 ensuring the selective connection of the cylinder with a common moisture analyzer 232, this latter being connected to the drive unit 16.

Scales 234A, 234B, 234C are provided at each filling station to ensure continuous weighing of the cylinders.

In this installation, the steps of initial rinsing and filling are carried out under the control of the drive unit using for each step a sequence of elemental tasks each defined by a procedure.

Figure 7:
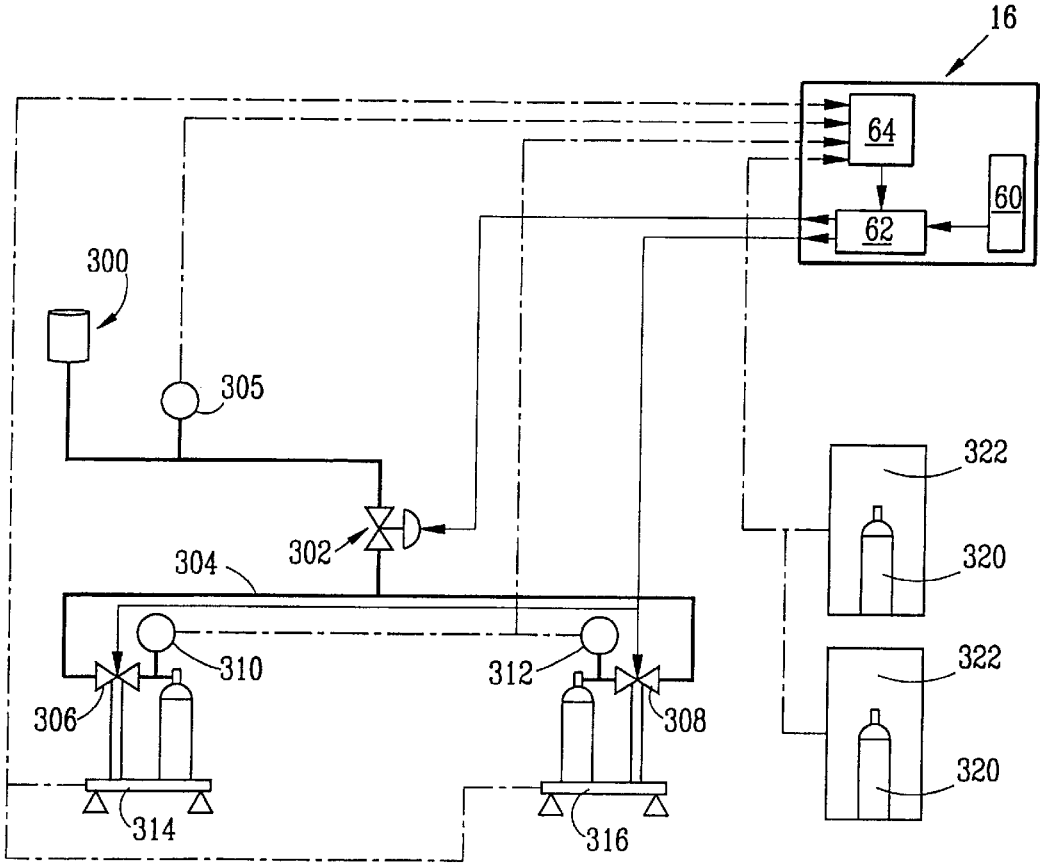
FIG. 7 is a schematic view of an installation for remeasuring cylinders of acetylene in a solvent and for controlling the mode of acetylene in the cylinders after filling.

In FIG. 7 is shown an installation for supplying solvent to an acetylene cylinder and for controlling the load of this cylinder after filling.

It comprises a source of solvent 300 such as acetone supplying, through a proportioning valve 302, a distribution conduit 304. A pressure detector 305 is provided downstream of the solvent source 300.

The distribution conduit 304 comprises two branches each supplying a cylinder to be filled, through a cutoff valve 306, 308. For each cylinder, a pressure detector 310, 312 is mounted at the outlet of the corresponding cutoff valve.

Moreover, a scales 314, 316 is provided for weighing each cylinder during its loading. The valves 302, 306, 308 are controlled by the drive unit 16 and the detectors 308, 310, 312 and the scales 314, 316 are connected to this same drive unit.

Two test cylinders 320 are provided with temperature probes 322. Each is placed within an enclosure whilst the other is disposed outside the enclosure. As a function of the cylinders to be treated, and particularly of their previous storage location, namely within an enclosure or outside it, one or the other of the test cylinders 302 is used as a temperature reference upon treatment.

It will be seen that with an installation according to the invention, the use of programs constituted by elemental procedures permits improving the reproducability of the sequences of filling no matter what the installation on which the filling is carried out. Moreover, the structure of the drive unit is relatively simple because it need not determine the sequence of filling but only carry it out.

What is claimed is:

1. Installation for filling at least one container with a gas whose nature is according to a predetermined specification, comprising:

a plurality of sources of supply gas (18, 20; 222, 228; 300);

at least one connector (14) for connecting said at least one container;

a network (12; 202A, 202B, 202C) of control valves, selectively connecting the outlet of each supply gas source to said at least one connector (14); and a control unit (16) for the network of valves adapted to control the condition of the valves for filling the or each receptacle with a gas according to the predetermined specification;

wherein:

each control unit (16) comprises means (60) for loading a program constituted by a sequence of procedures, each procedure comprising an elemental task that can be performed by the network of valves under the control of the control unit (16), and each control unit (16) comprises means (62) for processing successive procedures constituting the program, said means (62) are adapted to control the network of valves (12) for carrying out sequentially elemental tasks comprised successively in the sequence of procedures constituting the program.

2. Installation according to claim 1, characterized in that each procedure comprises the designation of a single valve to be controlled in the network (12) of valves, upon performance of the corresponding elemental task, and data relative to the mode of actuation of the valve.

3. Installation according to claim 2, characterized in that the data relating to the mode of actuation of each valve comprise a reference value, in that the installation comprises a plurality of detectors (36, 44A, 44B, 44C, 58; 80; 110; 120; 134, 136; 206A, 206B, 206C, 224, 234A, 234B, 234C; 305, 310, 312, 314, 316) adapted to carry out measurements of the condition of filling the or each container, and in that the processing means (62) are adapted to stop the actuation of the valve when the measurement carried out reaches the corresponding reference value.

4. Installation according to claim 2, characterized in that the data relating to the mode of actuation of the valve comprise the time delay, and in that the processing means (62) comprise a timer adapted to differentiate, from said time delay, the performance of the subsequent elemental task after the end of actuation of the designated valve in the procedure taking place.

5. Filling installation according to claim 1, characterized in that it comprises a vacuum pump (32) and the valve network (12) comprises means selectively to connect the vacuum pump (32) to the or each connector (14) under the control of said control unit (16) performing an elemental task of placing under vacuum comprised in the sequence of procedures constituting the program.

6. Installation according to claim 1, characterized in that it comprises an atmosphere outlet (28) and the network of valves (12) comprises means selective to connect the atmosphere outlet (28) to the or each connector (14) under the control of said control unit (16) performing an elemental task of connecting to the atmosphere, contained within the sequence of procedures constituting the program.

7. Installation according to claim 1, characterized in that it comprises at least two pluralities of connectors (46, 48, 50) for the connection of containers, said pluralities of connectors (14) are connected in parallel to the outlet of said network of valves (12) by means of a cutoff valve (52, 54, 56) belonging to each plurality of connectors.

8. Installation for filling at least one container with at least one gas having a predetermined composition, comprising:

at least two supply gas sources containing gases of different nature, at least one connecting means for connection to the container;

a network of control valves, operable to selectively connect the outlet of each supply gas source to the connecting means, and at least one sensor couplable to the container for sensing a filling gas-linked parameter and adapted to generate a signal representative of a condition of admission of gas within the container, a valve control unit adapted to control the state of the valves for filling the container with gas from the gas source, the control unit comprising input means for loading a filling program constituted by a sequence of procedures, each procedure comprising an elementary task that can be performed by the network of valves under the control of the control unit, and processing means for processing successive procedures constituting the program, said processing means adapted to receive and process the signal from the sensor and to control the network of valves for carrying out sequentially elementary tasks comprised successively in the sequence of procedures constituting the program.

9. Installation according to claim 8, wherein each procedure comprises identification of a single valve of said valve network, and data relative to the mode of actuation of the valve and including a reference value, and wherein the processing means comprise comparison means adapted to stop the actuation of the valve when the signal from the sensor equals the corresponding reference value.

10. Installation according to claims 8, characterized in that the data relating to the mode of actuation of the valve comprise the time delay, and in that the processing means (62) comprise a timer adapted to differentiate, from said time delay, the performance of the subsequent elemental task after the end of actuation of the designated valve in the procedure taking place.

11. Filling installation according to claim 8, characterized in that it comprises a vacuum pump (32) and the valve network (12) comprises means selectively to connect the vacuum pump (32) to the or each connector (14) under the control of said control unit (16) performing an elemental task of placing under vacuum comprised in the sequence of procedures constituting the program.

12. Installation according to claim 8, characterized in that it comprises an atmosphere outlet (28) and the network of valves (12) comprises means selective to connect the atmosphere outlet (28) to the or each connector (14) under the control of said control unit (16) performing an elemental task of connecting to the atmosphere, contained within the sequence of procedures constituting the program.

13. Installation according to claim 8, characterized in that it comprises at least two pluralities of connectors (46, 48, 50) for the connection of containers, said pluralities of connectors (14) are connected in parallel to the outlet of said network of valves (12) by means of a cutoff valve (52, 54, 56) belonging to each plurality of connectors.

14. Installation for filling at least one container with a gas whose nature is according to a predetermined specification, comprising:

a plurality of sources of supply gas (18, 20; 222, 228; 300);

at least one connector (14) for connecting said at least one container;

a network (12; 202A, 202B, 202C) of control valves, selectively connecting the outlet of each supply gas source to said at least one connector (14); and a control unit (16) for the network of valves adapted to control the condition of the valves for filling the or each receptacle with a gas according to the predetermined specification;

wherein:

each control unit (16) comprises means (60) for loading a program constituted by a sequence of procedures, each procedure comprising an elemental task that can be performed by the network of valves under the control of the control unit (16), and each control unit (16) comprises means (62) for processing successive procedures constituting the program, said means (62) are adapted to control the network of valves (12) for carrying out sequentially elemental tasks comprised successively in the sequence of procedures constituting the program;

wherein each procedure comprises the designation of a single valve to be controlled in the network (12) of valves, upon performance of the corresponding elemental task, and data relative to the mode of actuation of the valve;

wherein the data relating to the mode of actuation of each valve comprise a reference value, in that the installation comprises a plurality of detectors (36, 44A, 44B, 44C, 58; 80; 110; 120; 134, 136; 206A, 206B, 206C, 224, 234A, 234B, 234C; 305, 310, 312, 314, 316) adapted to carry out measurements of the condition of filling the or each container, and in that the processing means (62) are adapted to stop the actuation of the valve when the measurement carried out reaches the corresponding reference value; and wherein the plurality of detectors comprises at least one from among a detector (58) for measuring the temperature of the gas in at least one container, a scales (80; 110; 120; 234A, 234B, 234C; 314, 316) for weighing at least one container, a pressure detector (44A, 44B, 44C) disposed upstream of at least one container, and a humidity detector (232) disposed downstream of at least one container.

* * * * *